US006662741B1

(12) United States Patent
Van Der Laan

(10) Patent No.: US 6,662,741 B1
(45) Date of Patent: Dec. 16, 2003

(54) EMERGENCY TOWING SYSTEM FOR SHIPS

(75) Inventor: Markus Van Der Laan, Oegstgeest (NL)

(73) Assignee: Caltax Marine Diesel B.V., Kruiningen (NL)

( * ) Notice: Subject to any disclaimer, the term of this patent is extended or adjusted under 35 U.S.C. 154(b) by 0 days.

(21) Appl. No.: 09/763,689

(22) PCT Filed: Aug. 24, 1999

(86) PCT No.: PCT/NL99/00529

§ 371 (c)(1),
(2), (4) Date: Feb. 26, 2001

(87) PCT Pub. No.: WO00/10870

PCT Pub. Date: Mar. 2, 2000

(30) Foreign Application Priority Data

Aug. 25, 1998 (NL) ..... 1009938

(51) Int. Cl.[7] ..... B63B 21/16; B63B 21/58
(52) U.S. Cl. ..... 114/254; 114/249
(58) Field of Search ..... 114/199, 179, 114/230.2, 230.26, 230.28, 242, 243, 249–254

(56) References Cited

U.S. PATENT DOCUMENTS

| | | | | | |
|---|---|---|---|---|---|
| 336,829 | A | * | 2/1886 | Winter | 114/254 |
| 1,016,619 | A | * | 2/1912 | Froger | 114/253 |
| 1,520,144 | A | * | 12/1924 | Sansom | 114/251 |
| 3,147,732 | A | * | 9/1964 | Nishioka | 114/254 |
| 3,483,841 | A | * | 12/1969 | Blackburn | 114/251 |
| 3,804,168 | A | * | 4/1974 | Marshall et al. | 166/385 |
| 3,892,386 | A | * | 7/1975 | Hogan | 114/254 |
| 3,917,229 | A | * | 11/1975 | Ayme | 114/254 |
| 4,100,875 | A | * | 7/1978 | Patterson et al. | 114/251 |
| 4,587,920 | A | * | 5/1986 | Thompson | 114/251 |
| 5,595,135 | A | * | 1/1997 | Jensen | 114/253 |
| 5,967,076 | A | * | 10/1999 | Tinnen | 114/254 |

FOREIGN PATENT DOCUMENTS

| | | | | |
|---|---|---|---|---|
| DE | 165866 | * | 3/1918 | 114/199 |
| DE | 43 29 557 A1 | | 3/1995 | |
| WO | WO 97/11876 | | 4/1997 | |

* cited by examiner

*Primary Examiner*—S. Joseph Morano
*Assistant Examiner*—Andrew Wright
(74) *Attorney, Agent, or Firm*—Young & Thompson

(57) ABSTRACT

An emergency towing system for vessels. This system comprises a return guide fitted to the vessel to be towed; a closed ring-cable is fitted around this return guide, wherein this ring-cable comprises a coupling-member which, when the ring-cable is heaved around, establishes a connection with a contra-coupling-member on the vessel to be towed.

20 Claims, 11 Drawing Sheets

EMERGENCY TOWING SYSTEM FOR SHIPS

The present invention relates to an emergency towing system for shipping vessels.

Shipping accidents have lead to stricter international regulations. International rules have recently come into effect which require an emergency towing connection onboard various types of ships. A towing system should be fitted to the ship which would give a tugboat the possibility of assisting an out of control vessel in an emergency.

In practice, a first connection is often brought about by shooting a light line across from the tugboat to the ship to be towed. Onboard the ship which is to be towed, this is caught by people or by an automatic mooring system. A second possibility for making the first connection is to throw a buoy overboard with a connecting line from the ship that is to be towed. The tugboat then travels to this buoy and fishes both the buoy and the connecting line out of the water.

As soon as the first connection has been established, the light line is fastened to a winch on the tugboat and is used to bring a heavier cable across from the tugboat to the vessel to be towed. This process is continued until the actual towline has been brought across. After making the connection, the tugboat can tow the vessel.

So as not to be dependent on a winch on the ship to be towed, a return guide, such as a 'roller pedestal', is often fitted onboard this ship. The light cable can be laid around the roller and the free end can be brought over to the tugboat. In an emergency, however, it is difficult to get this cable to the tugboat. As soon as the light cable is back on the tugboat, the winch in the tugboat can be used to bring the heavier cable over, using the light cable via the roller.

In both cases, human intervention is needed on the ship to be towed, but this is not always possible in emergencies and in bad weather.

A number of proposals have been made to solve these problems. A first proposal is the permanent fitting of a heavy towline onboard the ship to be towed. The light connecting line can be directly coupled onto this and can bring the heavy towline over to the tugboat. This proposal means the permanent fitting of a large towline onboard the ship, with considerable cost, storage space and maintenance.

A second proposal is the fitting of a chain with a hook-system as described in WO 9711876. This system offers the possibility of still making a towing connection, without a towline being onboard the vessel to be towed. Here, a closed ring-cable is secured through the end link of the chain, by which the chain is pulled overboard. A special hook is also brought over to the tugboat. The tugboat attaches the towing line to this hook and pulls the hook via this ring-cable back to the ship to be towed, where the hook hooks into the chain. This system has a number of disadvantages, including:

1. Limited reliability of functioning due to the turning of both the chain and the messenger line, and the chance of a break during the peak load of the hooking in, and 2. The large load on the messenger line during the pulling around and hooking in of the hook. This system also consists of a number of parts which lie on the vessel's deck in all weather and, in doing so, require maintenance and repairs.

The aim of the present invention is to provide an improved device which does not have the disadvantages mentioned above, that is, reduction of costs and maintenance and an increase in the reliability in emergencies and bad weather and without human presence on the vessel to be towed.

This aim is realized in an emergency towing system for shipping vessels, which comprises a return guide, fitted to the vessel to be towed, around which a closed ring-cable is fitted, wherein the ring-cable comprises a coupling-member which, when the ring-cable is heaved around, establishes contact with a contra-coupling-member on the vessel to be towed.

The return guide can comprise all constructions known in the state of the art to return a cable with minimum resistance, such as a roller. It should also be understood that a rounded object with a smooth surface can also be used in place of a roller.

The ring-cable can be connected to the light line of the tugboat; this can be done in any way known in the state of the art, both manually and automatically. The tugboat can then pull this closed ring towards itself.

By providing this ring-cable with a coupling-member, the heavier towline can be pulled around to the vessel to be towed and the coupling-member can hook into the contra-coupling-member onboard the vessel to be towed.

The coupling mechanism can comprise any of the constructions known in the art. According to an advantageous embodiment, the coupling-member is realized as a pin in the length of the ring-cable, whereby the connection between the pin and the cable is smooth. In this way, the pin can be pulled towards the ship to be towed without hooking onto anything. The contra-coupling-member in this embodiment is implemented as a tube-shaped opening with rounded edges. The closed ring-cable goes through the contra-coupling-member and, by pulling on the other part of the ring-cable, the connecting pin is easily pulled into the opening of the contra-coupling-member, guided by the rounded edges. The connection is made when the pin is pulled into the contra-coupling-member; for this purpose, the pin is provided with a countersunk edge and the contra-coupling-member has sprung projections on the inside. When the pin is pulled in, the projections are pushed apart by the shape of the pin and then move towards each other again as soon as the countersunk edge of the pin is reached. The pin is caught behind the projections and, in this way, the connection is realized. By implementing the pin so that it is rotationally symmetrical, the connection is no longer dependent on the correct turning of the connecting lines.

By this implementation, a reliable system is realized which also functions in emergencies and in bad weather.

By protecting both the return guides and the closed ring-cable from dirt and corrosion, the reliability is increased and the maintenance costs decrease.

According to an advantageous embodiment, both cables of the ring-cable are independently lead outside through openings in the ships outer shell, whereby one of the two openings is used for the contra-coupling-member and the other as the 'pull through' opening. This stops the two connecting lines from hindering each other in one opening, both during the pulling around and the hooking-in of the pin.

According to a further advantageous embodiment, the closed ring-cable is stored in a separate box, wherein only the two ends protrude and are connected to the coupling-member via the contra-coupling-member and around the roller. This embodiment makes it possible, during the installation and maintenance, to handle the whole cable in the box as one part. The cable can first be stowed away in the box in a controlled manner.

To guarantee the reliable paying out of the cable, the cable should be stored in zigzag layers in the box. As a result of the zigzag structure, the cable does not rotate during paying out, preventing the cable from getting tangled and from hindering the functioning of the system.

As both ends of the ring-cable should feed out simultaneously, the ring-cable should either be installed in two separate boxes or a double cable together in a zigzag structure in one box. Practical tests show that the paying out from two separate boxes is more reliable and requires less effort.

The invention will be further elucidated below with reference to the example embodiment shown in the drawings.

FIGS. 1*a* and 1*b* are schematic representations, in a top-down and side view, of the vessel to be towed 1, the tugboat 2 and the first light connecting line 3.

Figure 7A:
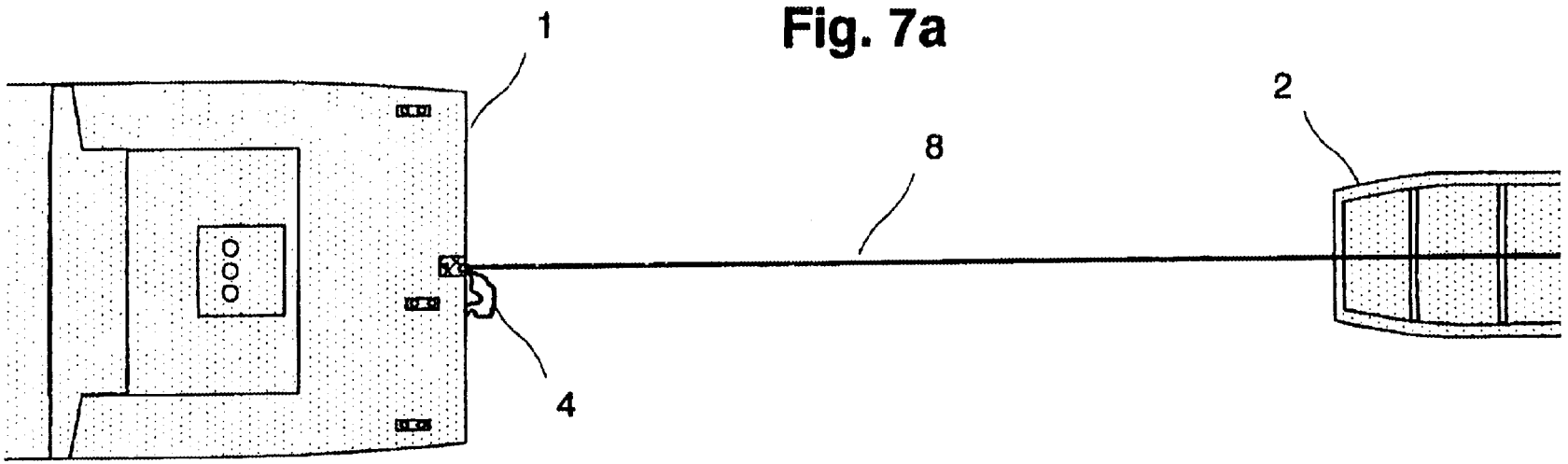
Figure 7B:
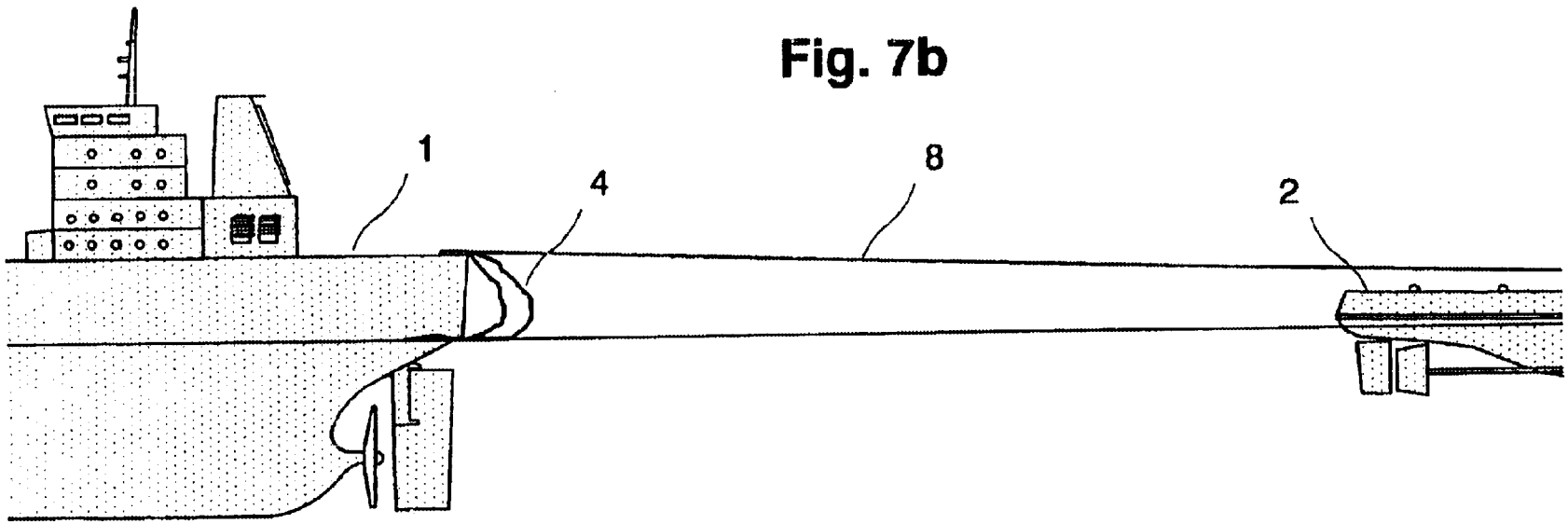

FIGS. 7*a* and 7*b* show the detailed drawing of the towing connection between the vessel to be towed and the tugboat, in a top-down and side view.

Figure 8:
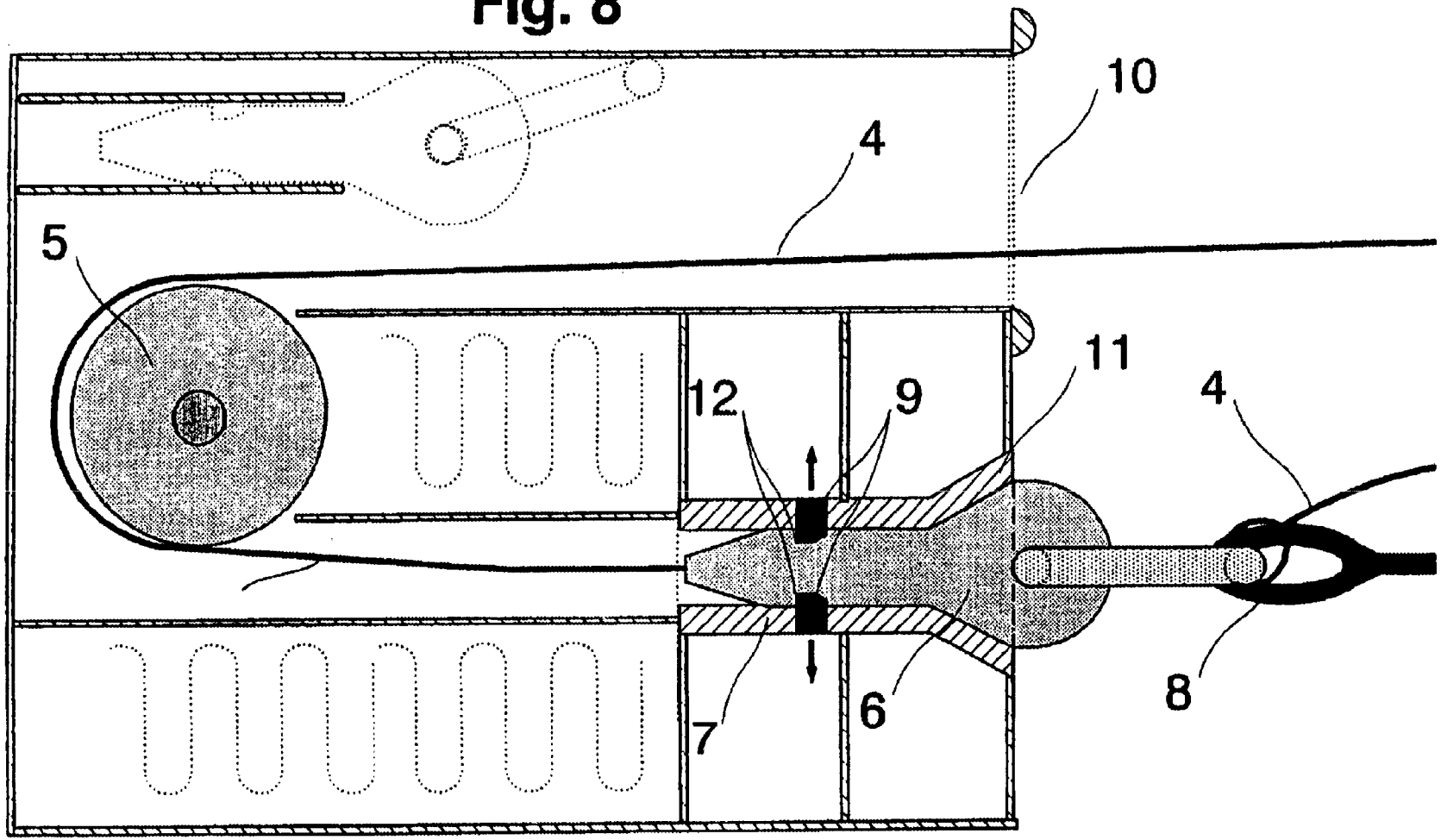
Figure 9:
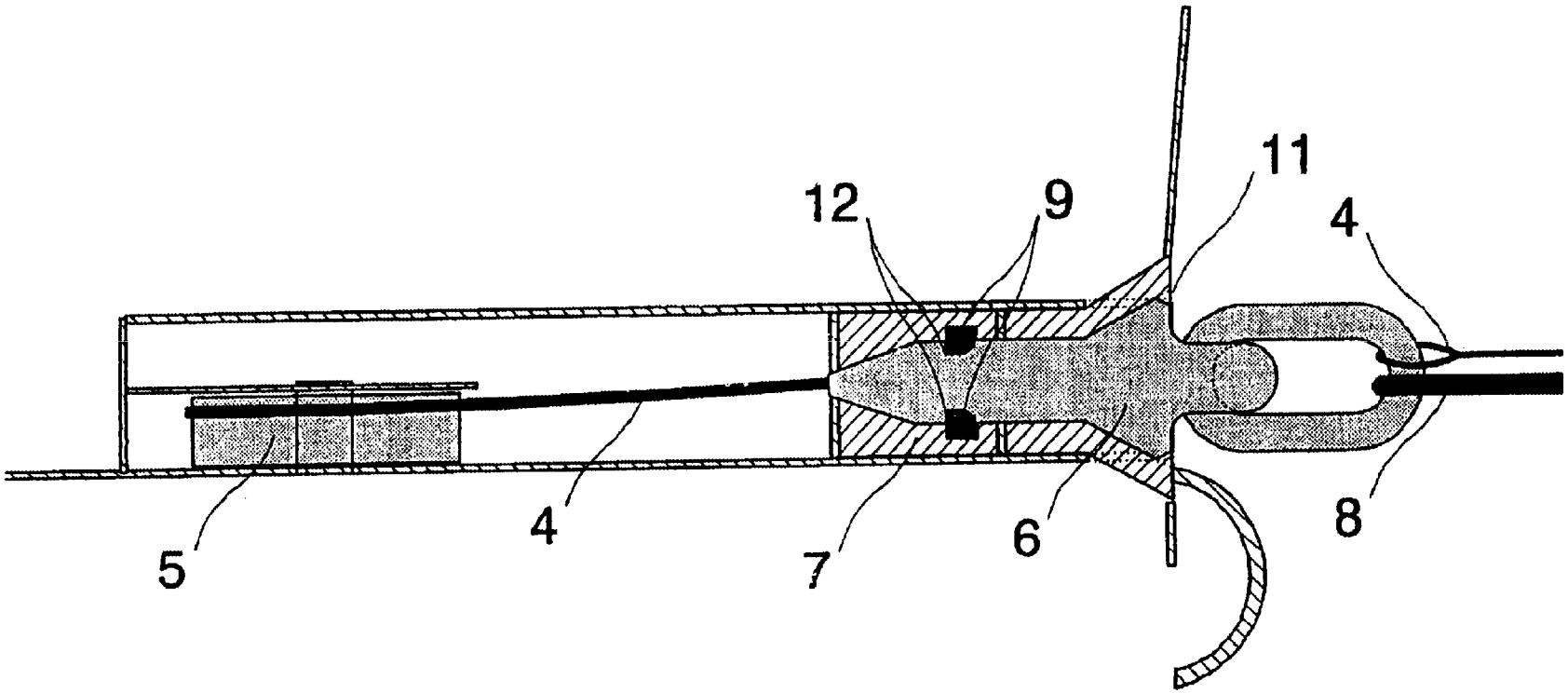

FIGS. 8 and 9 show a detailed cross-sectional drawing of the contra-coupling-member and the connecting pin, in a top-down and side view.

Figure 10:
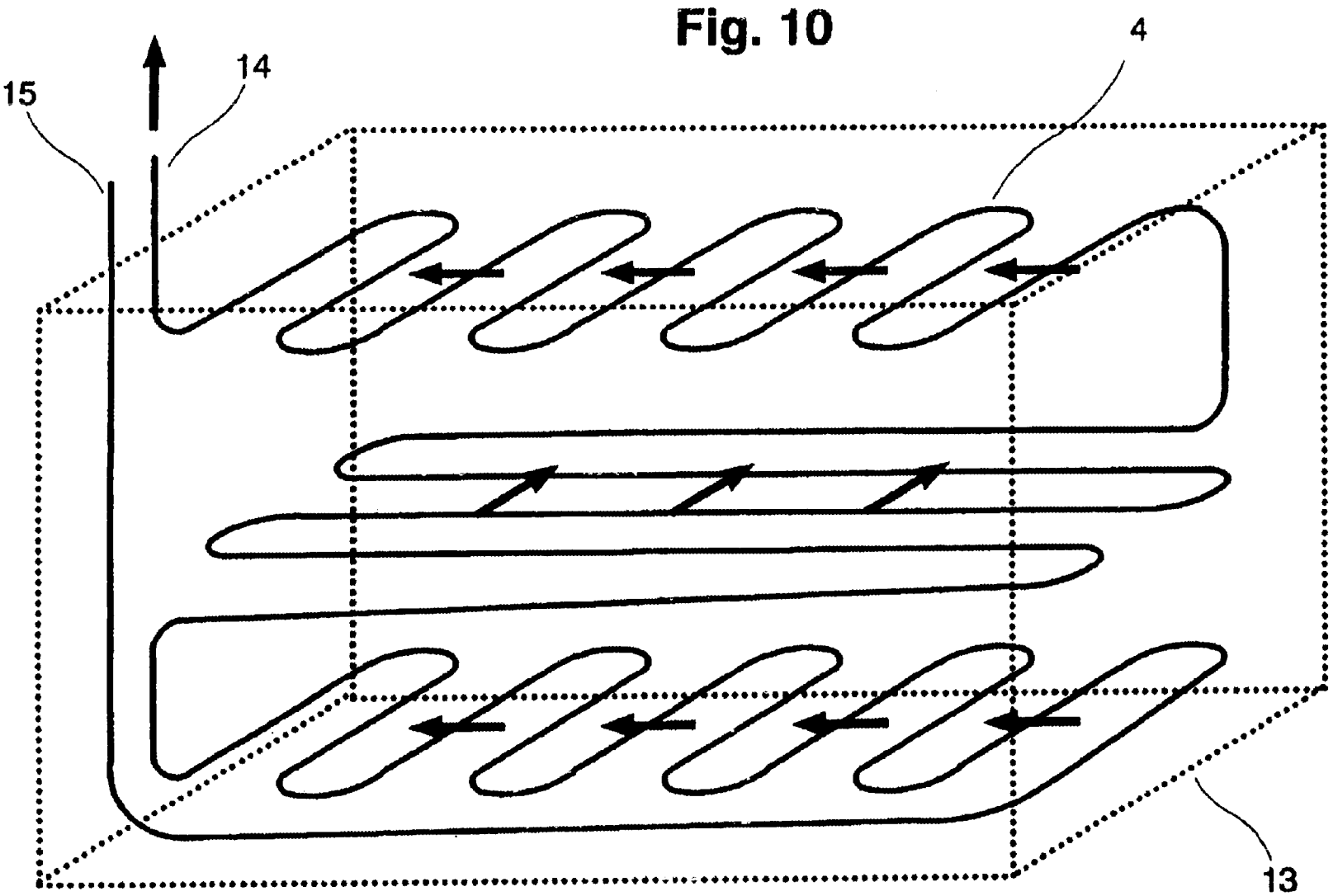

FIG. 10 shows a three-dimensional drawing of the storage method of the ring-cable in the box.

Figure 11:
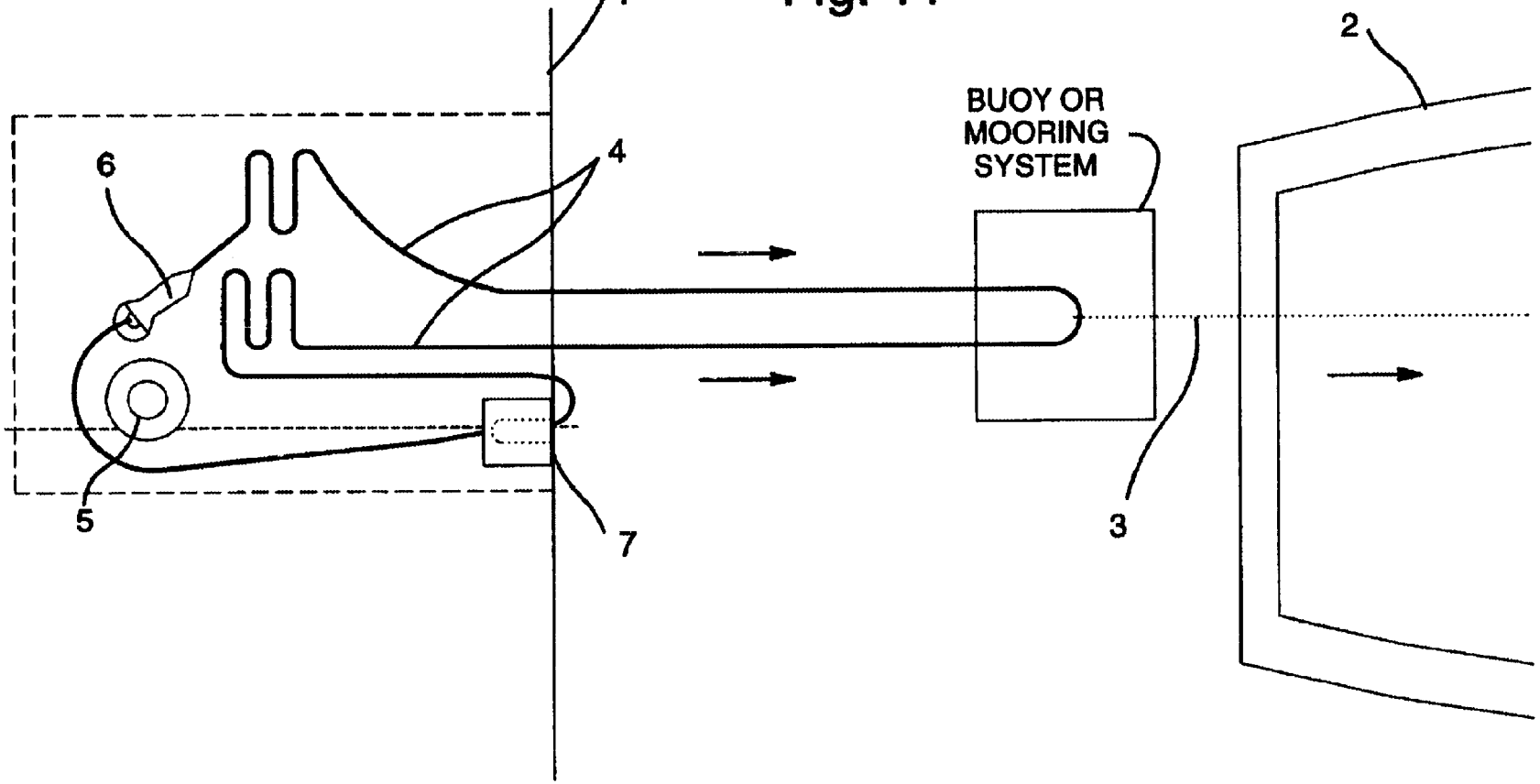

FIG. 11 shows an embodiment including connection of a ring-cable to a buoy or mooring system.

Figure 1A:
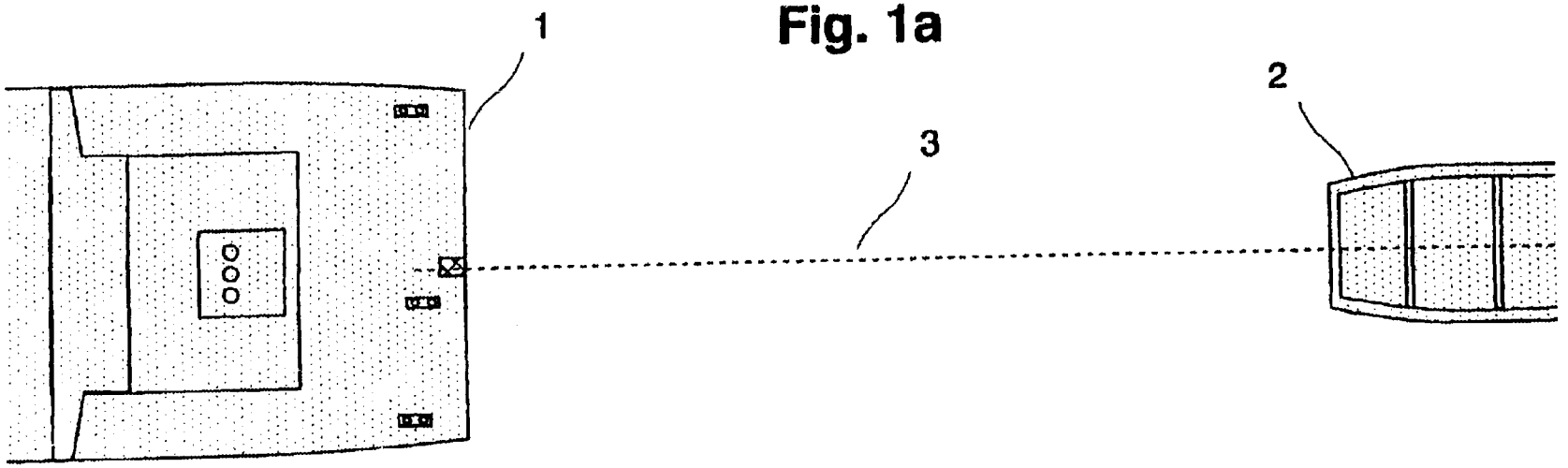
Figure 1B:
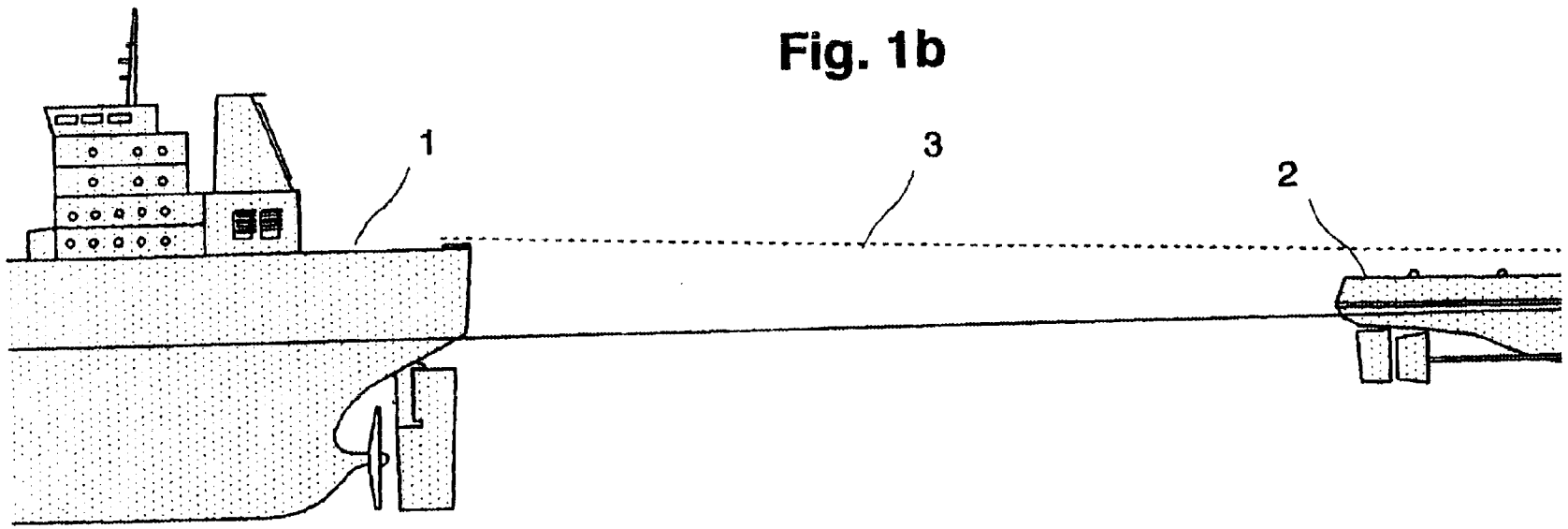

In FIGS. 1*a* and 1*b*, only the back section of the vessel 1 to be towed is shown. The tugboat 2 has already brought a light connecting line 3 across to the vessel to be towed.

Figure 2:
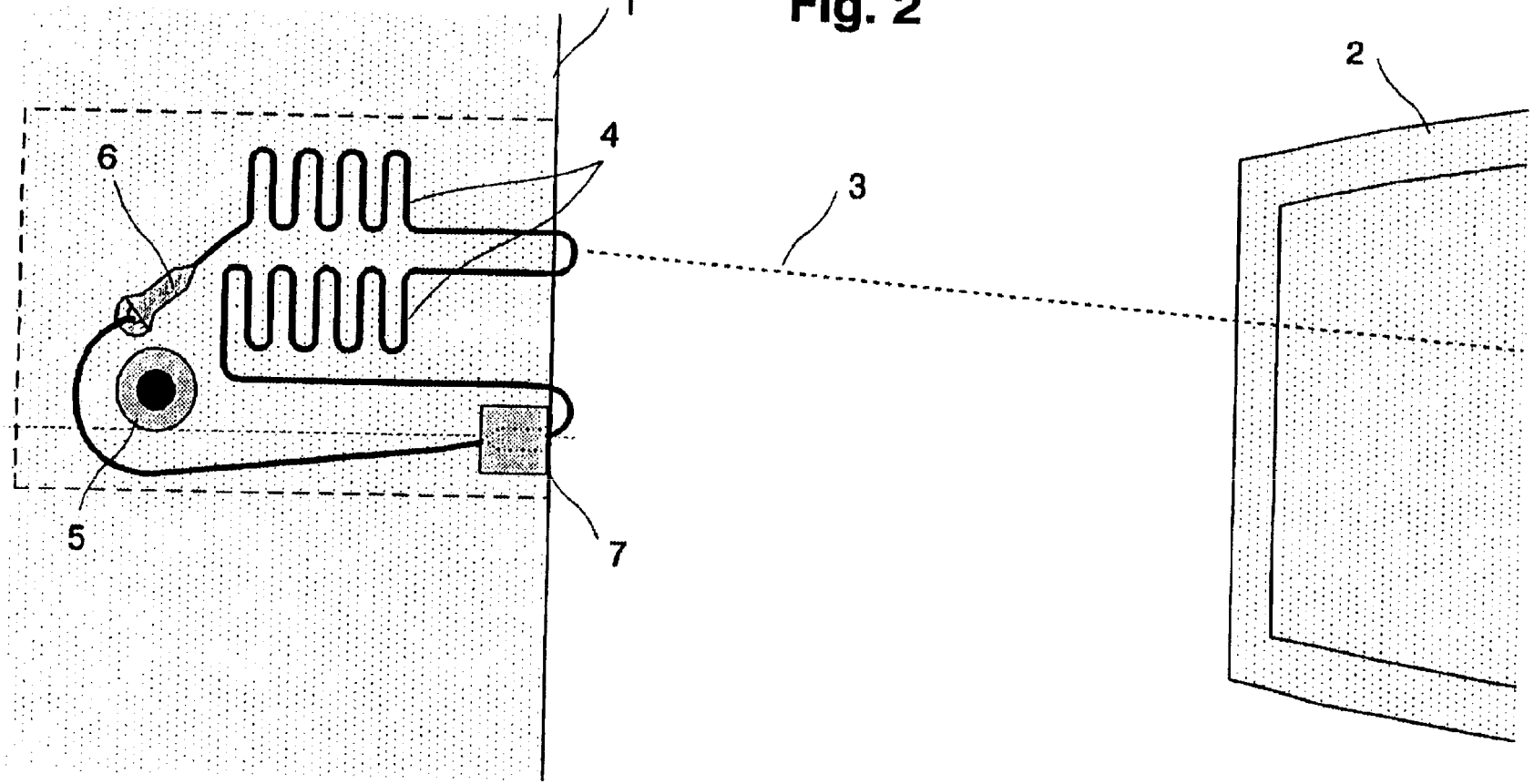
FIG. 2 is a detailed representation of the system on the stern of the ship to be towed 1.

In FIG. 2, the embodiment according to the invention is represented schematically on the back end of the ship to be towed 1. Again, the tugboat 2 and the light connecting line 3 are shown. The embodiment according to the invention comprises the following parts: the closed ring-cable 4 fitted around the roller 5. This ring-cable is provided with a coupling-member 6 and a contra-coupling-member 7 which is permanently fixed to the vessel to be towed.

Figure 3:
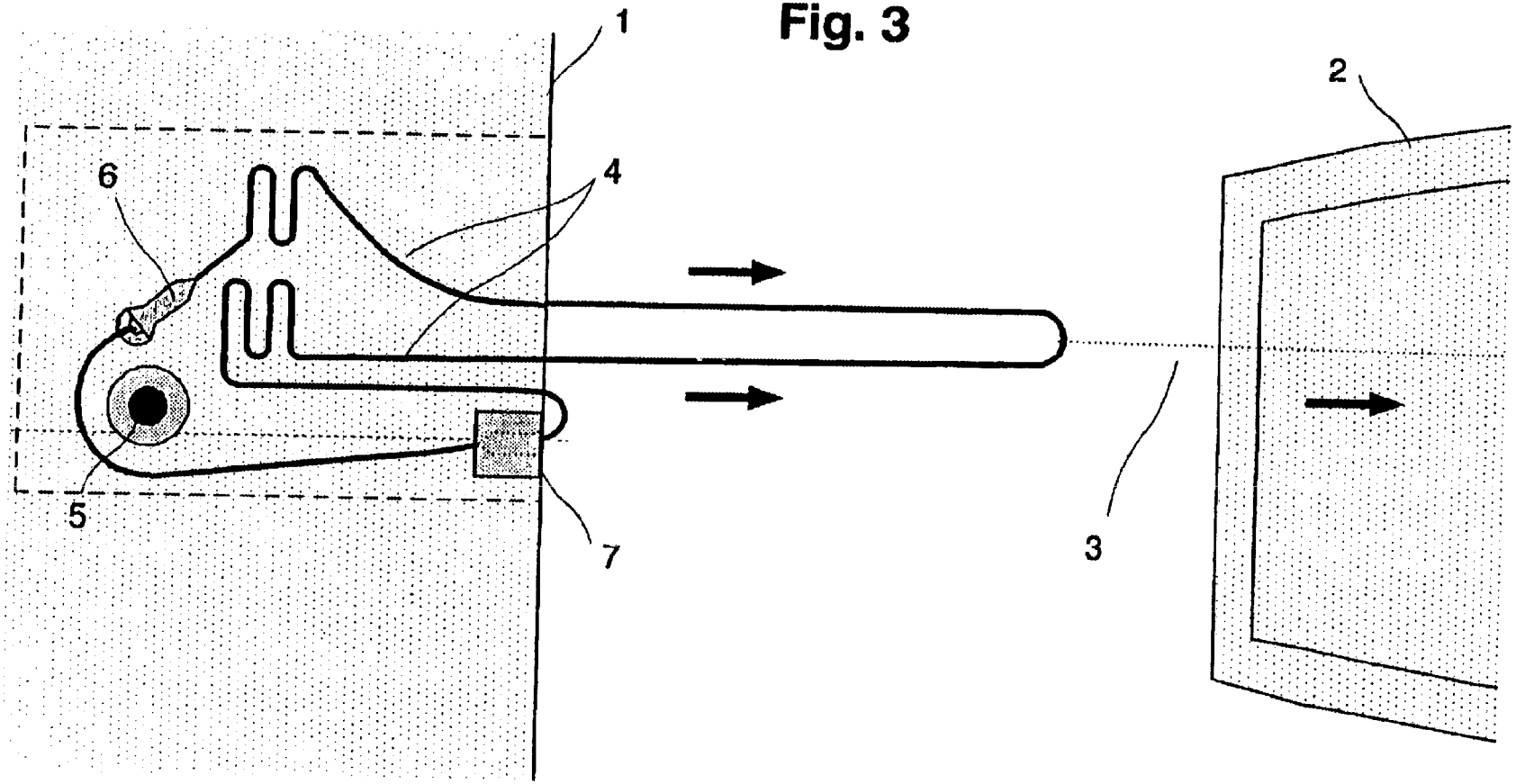
FIGS. 3–6 show the steps for making a towing connection between the vessel to be towed and the tugboat.
Figure 4:
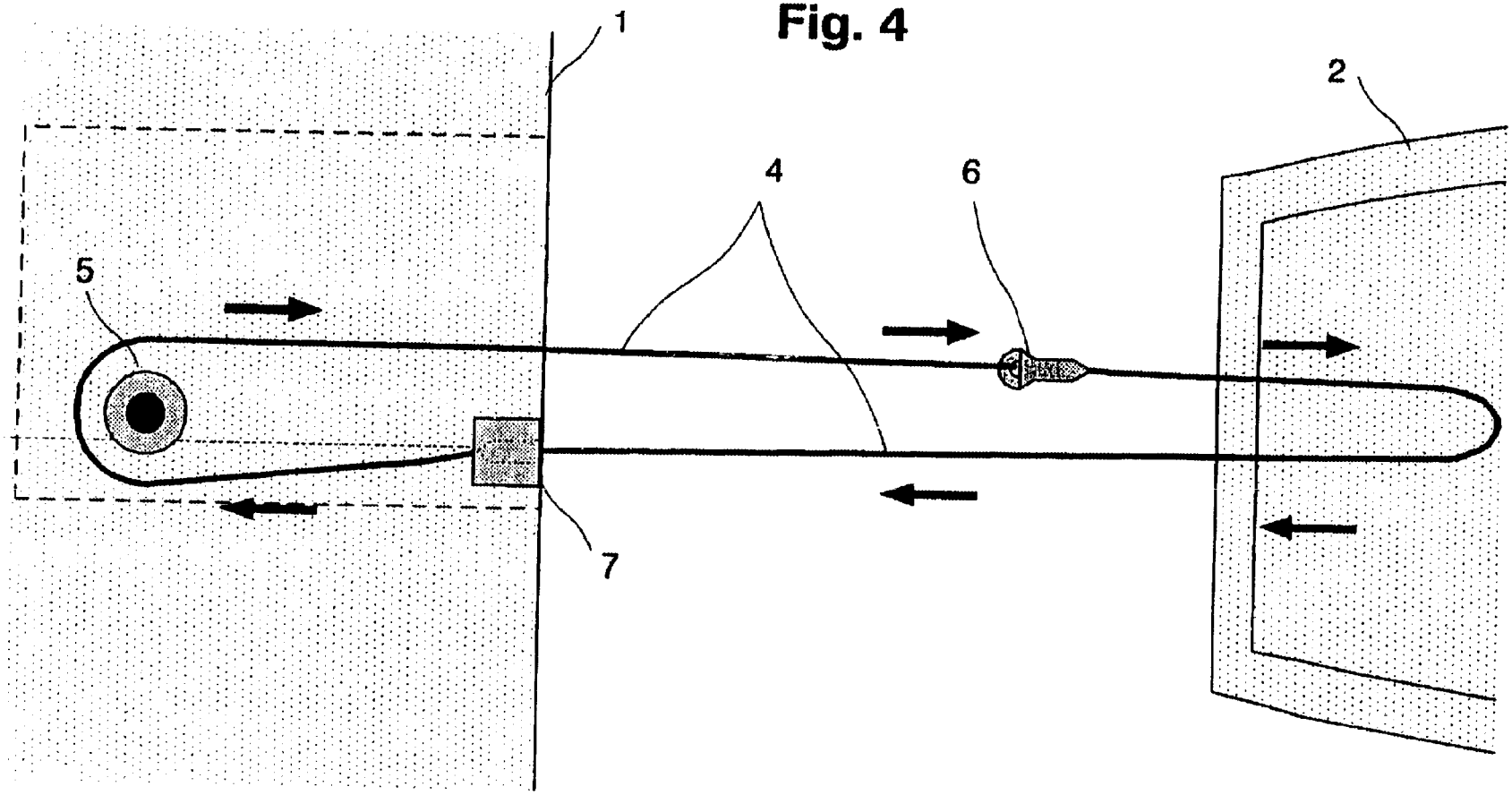
Figure 5:
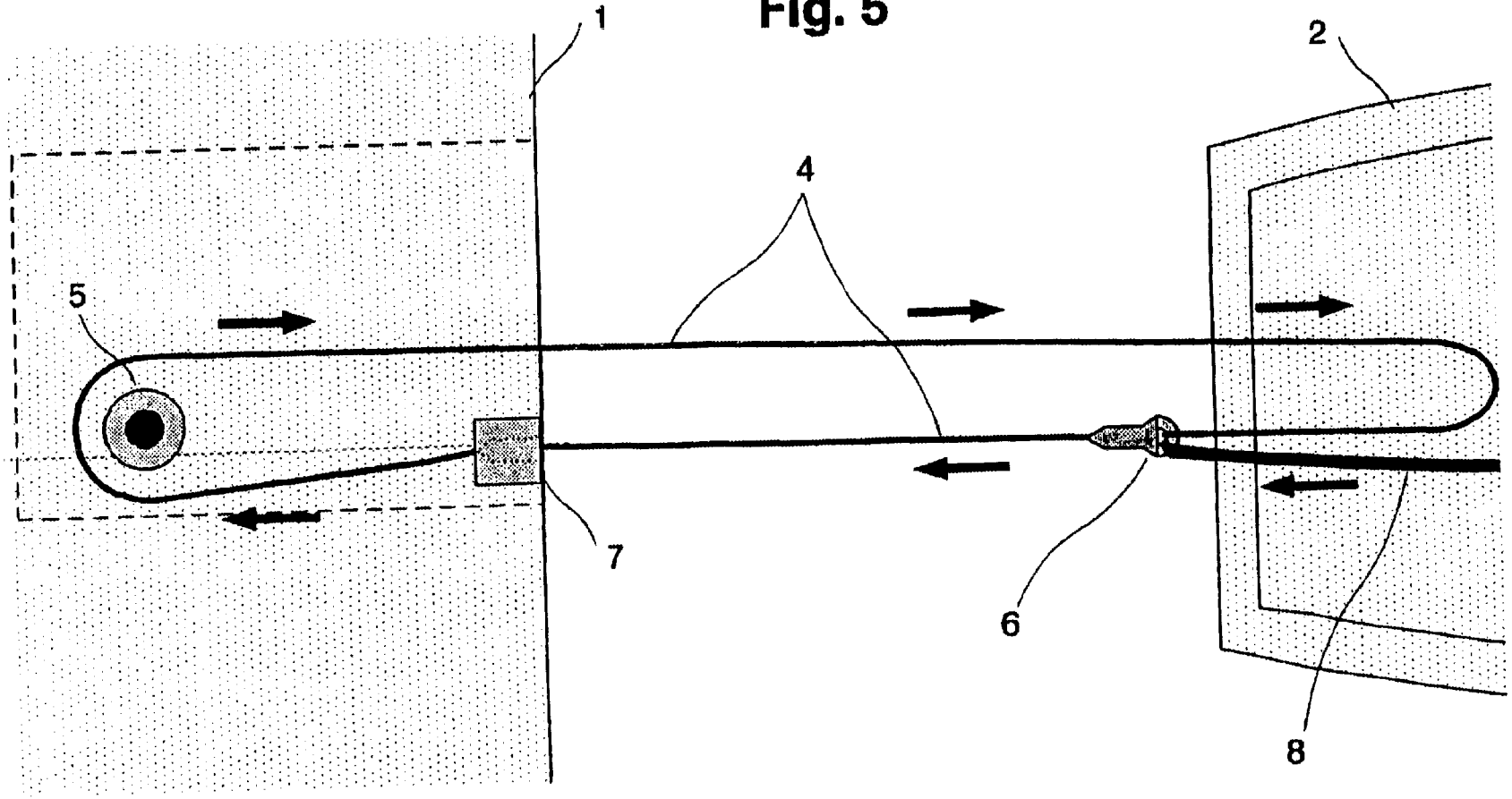
Figure 6:
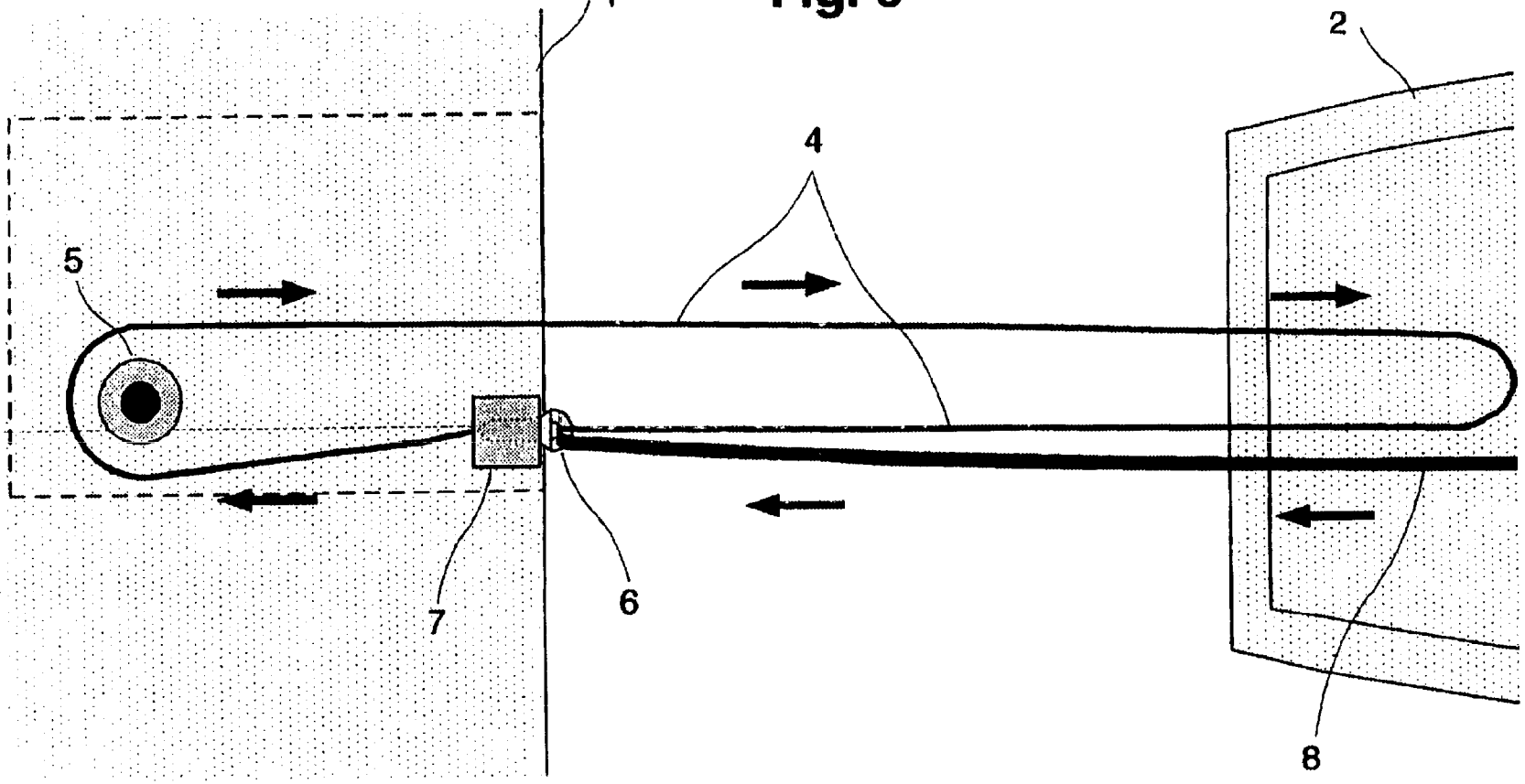

In FIGS. 3–6, the steps for making the towing connection are represented schematically. In FIG. 3, the ring-cable 4 is pulled towards the tugboat with the light connecting cable 3. In FIG. 4, the ring-cable 4 is onboard the tugboat and is pulled from one end and the other end is payed out. In this way, the coupling-member 6 is moved from the ship to be towed to the tugboat. In FIG. 5, the coupling-member is onboard the tugboat and the heavy towline 9 is attached to it. Then, the coupling-member 6 and the heavy towline 9 are pulled towards the vessel to be towed 1 by means of the closed ring-cable 4. In FIG. 6, the coupling-member 6 makes a connection with the contra-coupling-member 7 and, in this way, the heavy towing connection is realized. The tugboat can then tow the vessel to be towed.

In FIGS. 7*a* and 7*b*, the final towing connection with the heavy towline 9 is represented. The tugboat has released the closed ring-cable 4.

In FIGS. 8 and 9, the contra-coupling-member and the connecting pin are shown in more detail. The connecting pin 6 is shown in the contra-coupling-member 7, whereby the projections 9 have already slid into the countersunk edges 12 of the pin. The pin is automatically lead into the contra-coupling-member due to the cone-shaped opening 11 of the contra-coupling-member. The one part of the ring-cable 4 goes from the end of the pin through the contra-coupling-member 7, around the roller 5 and returns via the 'pull through' opening 10. The other part of the ring-cable 4 and the heavy towline 8 are connected onto the other side of the pin 6.

In FIG. 10, the ring-cable 4 is represented in a separate box 13. This is only one half of the ring-cable, the other half is stored in the second identical box. The ring-cable is stored in the box in horizontal zigzag layers; every zigzag is positioned diagonally across the underlying layer. The ring-cable end 14 is connected to the same ring-cable end 14 from the other box and is also connected to the light connecting line 3. By pulling on the connecting line, the ring-cable 4 comes out of the box in the direction of the arrows, zigzagged in horizontal layers.

In FIG. 11, the ring-cable 4 is connected to a buoy or mooring system.

The ring-cable end 15 goes through the contra-coupling-member, around the roller to the connecting pin 6 and through the same ring-cable end 15 from the other box.

As a result of the invention, it is no longer necessary to install a towline on the vessel to be towed.

While the invention above is described with reference to a preferred embodiment, numerous changes can be realised without leaving the scope of the present application. The system can be fitted on various positions on the vessel, both at the deck-level and above or below it. It can also be installed on the prow or the stern.

What is claimed is:

1. Emergency towing system for shipping marine vessels, comprising at least a return guide fitted to the vessel to be towed around which a closed ring-cable is fitted, wherein the ring-cable is provided with a coupling-member, equipped to grip onto a contra-coupling-member while traveling in a first direction, which is fitted to the vessel to be towed, during the moving around of the closed ring-cable, said coupling-member comprising means for attachment of a heavy towline from a towing vessel providing a towing connection between the vessel to be towed and said towing vessel, wherein a towing force exerted by the towing vessel along the heavy towline is in a direction opposite the first direction.

2. Emergency towing system according to claim 1, wherein the contra-coupling-member is provided with a through-opening to receive the ring-cable.

3. Emergency towing system according to claim 2, wherein the coupling-member is part of the ring-cable and is lockable in that through-opening.

4. Emergency towing system according to claim 1, wherein the coupling-member is rotationally symmetrical.

5. Emergency towing system according to claim 1, wherein either the ring-cable itself or a connected connection member protrudes through an opening in the ship's outer shell.

6. Emergency towing system according to claim 1, wherein respective portions of the ring-cable on opposite sides of the return guide each protrude from a separate opening in an outer shell of the vessel being towed.

7. Emergency towing system according to claim 1, wherein the means for attachment of the heavy towline comprises an eye to attach the heavy towline.

8. Emergency towing system according to claim 1, wherein the contra-coupling-member is placed in an opening in the ship's outer shell.

9. Emergency towing system according to claim 1, wherein the coupling-member is a pin with a countersunk edge, wherein the contra-coupling-member is shaped to engage said countersunk edge.

10. Emergency towing system according to claim 1, comprising a cover for a least the coupling-member and the ring-cable.

11. Emergency towing system according to claim 1, wherein the ring-cable is connected to a buoy or a mooring system.

12. Emergency towing system according to claim 1, wherein the ring-cable is stored in one or more separate boxes.

13. Emergency towing system according to claim 1, wherein the ring-cable is stored in zigzag layers in at least one box.

14. Emergency towing system for establishing a connection of a heavy towline between a marine towing vessel and a vessel to be towed, comprising:

a return guide disposed on the vessel to be towed;

a closed ring-cable passing around the return guide and extending between the towing vessel and the vessel to be towed, the ring-cable having a coupling-member comprising a means for attachment of the heavy towline from the towing vessel; and a contra-coupling-member disposed on the vessel to be towed, the contra-coupling-member being arranged and shaped to achieve a secure engagement with the coupling-member while traveling in a first direction when the closed ring-cable is passed around the return guide and the coupling-member with the heavy towline attached is brought into contact with the contra-coupling-member, wherein a towing force exerted by the towing vessel along the heavy towline is in a direction opposite the first direction.

15. Emergency towing system according to claim 14, wherein the contra-coupling-member is provided with a through-opening to receive the ring-cable.

16. Emergency towing system according to claim 15, wherein the coupling-member is part of the ring-cable and is lockable in the through-opening.

17. Emergency towing system according to claim 14, wherein the coupling-member is rotationally symmetrical.

18. Emergency towing system according to claim 14, wherein the means for attachment comprises an eye for attachment of the heavy towline.

19. Emergency towing system according to claim 14, wherein the contra-coupling-member is arranged in an opening in an outer shell of the vessel to be towed.

20. Emergency towing system according to claim 14, wherein the coupling-member comprises a pin with a countersunk edge, the contra-coupling-member being arranged to engage the countersunk edge.

* * * * *